United States Patent [19]

Allen

[11] 4,026,358

[45] May 31, 1977

[54] METHOD OF IN SITU RECOVERY OF VISCOUS OILS AND BITUMENS

[75] Inventor: Joseph C. Allen, Bellaire, Tex.

[73] Assignee: Texaco Inc., New York, N.Y.

[22] Filed: June 23, 1976

[21] Appl. No.: 698,983

[52] U.S. Cl. ..... 166/261; 166/263; 166/272

[51] Int. Cl.[2] ..... E21B 43/24

[58] Field of Search ..... 166/272, 261, 263, 256, 166/303

[56] References Cited

UNITED STATES PATENTS

| | | | |
|---|---|---|---|
| 2,862,558 | 12/1958 | Dixon | 166/272 |
| 2,897,894 | 8/1959 | Draper et al. | 166/272 |
| 3,036,632 | 5/1962 | Koch et al. | 166/272 X |
| 3,093,191 | 6/1963 | Glass | 166/261 |
| 3,402,770 | 9/1968 | Messenger | 166/272 X |
| 3,459,265 | 8/1969 | Buxton et al. | 166/272 X |
| 3,572,437 | 2/1969 | Marberry et al. | 166/272 |
| 3,768,559 | 10/1973 | Allen et al. | 166/272 |
| 3,964,546 | 6/1976 | Allen | 166/272 X |

*Primary Examiner*—Stephen J. Novosad
*Attorney, Agent, or Firm*—Thomas H. Whaley; Carl G. Ries; Charles L. Bauer

[57] ABSTRACT

A method for recovering low-gravity viscous oils and bitumen hydrocarbons from a subterranean hydrocarbon-bearing formation by injecting thereinto a hydrocarbon solvent saturated with a gas, and thereafter establishing a thermal sink in the formation, followed by a soak period, and production of the hydrocarbons therefrom.

14 Claims, No Drawings

METHOD OF IN SITU RECOVERY OF VISCOUS OILS AND BITUMENS

BACKGROUND OF THE INVENTION

This invention relates to a method for recovering hydrocarbons from a subterranean hydrocarbon-bearing formation containing low-gravity viscous oils or bitumens. More particularly, this invention relates to recovery of hydrocarbons from tar sands.

The recovery of viscous oils from formations and bitumens from tar sands by conventional methods has generally been unsuccessful because of the high viscosity and low mobility of the oil or bitumens. While some success has been realized in stimulating recovery of heavy oils by the use of thermal methods, essentially no success has been realized in recovering bitumens from tar sands. Bitumens can be regarded as highly viscous oils having a gravity in the range of about 5° to 10° API and contained in an essentially unconsolidated sand. These formations containing bitumens are referred to as tar sands. One such deposit is the Athabasca tar sands located in Alberta, Canada, which is estimated to contain some seven hundred billion barrels of oil.

Among the conventional thermal recovery methods applied to produce viscous hydrocarbons from formations and bitumens from the tar sands are steam injection, hot water injection and in-situ combustion. Using these thermal methods, the in-situ hydrocarbons are heated to temperatures at which their viscosity is sufficiently reduced and their mobility is sufficiently improved so as to enhance their flow through the pores of the formation.

Typically, such thermal techniques employ an injection well and a production well traversing the oil-bearing or tar sand formation. In a steam operation the heat furnished by the injected steam functions to lower the viscosity of the oil, thereby improving its mobility, while the fluid flow of the steam through the formation functions to drive the oil toward the production well from which the oil is produced.

In the conventional in-situ combustion operation, characteristically much higher temperatures, i.e. above the ignition temperature of the crude, are obtained than in a steam operation. An oxygen-containing gas such as air is injected into the formation and combustion of a portion of the in-place crude adjacent the wellbore is initiated by one of many accepted means, such as the use of a downhole gas-fired heater or a downhole electric heater or chemical means. After initiation of combustion has occurred, the injection of the oxygen-containing gas is continued so as to maintain a combustion front which is formed and to drive the front through the formation toward the production well. As the combustion front moves through the formation, the hot gases and liquids moving in advance of the combustion front vaporize the volatile components of the formation fluids and displace them ahead of the front. Only the higher boiling components of the oil remain and they serve to provide fuel for continuation of the process. The volatilized components move in the vapor phase until they reach a zone where the composition and temperature of the formation are such that they are either condensed or absorbed in the oil.

Another technique that has been employed to recover viscous hydrocarbons is the use of hydrocarbon solvents. For example, it is well known that aromatic solvents, such as toluene and benzene, are capable of dissolving the heavier hydrocarbon components in heavy oils or bitumens, thereby improving their mobility by dilution. Aromatic solvents are generally more effective than paraffinic-type solvents since the asphaltic components of the oils are less soluble in paraffinic solvents. The solvents have a beneficial result in that they dilute the crude and thus make the crude more mobile. However, their use has not been practical commercially since their cost is high and recovery of the solvent tends to be low.

It is also known to inject hot solvent into the formation to accomplish a hot solvent extraction. However, surface fuel and expensive equipment are required. In addition, surface heating is relatively inefficient and rather elaborate and rigorous procedures are required because of the possibility of fires and explosions.

Among the difficulties that arise in the practice of thermal methods of recovery is the lack of conformance. Conformance is defined as the volumetric fraction or percent of the oil-bearing formation that is invaded or swept by the injected fluid or swept by the injected fluid or fluids in secondary recovery operations. Conformance is also expressed in terms of horizontal and vertical sweep efficiencies. It is the most inefficient parameter of a recovery operation. The injected fluid follows the path or paths having the highest transmissibility, which could represent a very small fraction of the total reservoir. For example, in the in-situ combustion process, the fronts are propagated at velocities that cause them to pass preferentially through the more permeable areas of the formation and bypass the less permeable areas. Thus, there are some unburned areas from which no oil is recovered. There is also the undesirable result that, with the passage of each successive front, the tendency of the oxygen-containing gas to follow previously created channels increases. Thus, the efficiency of the process is low and it continues to decrease if the injection and production are continued.

One suggestion for improving conformance is the injection of water either simultaneously or intermittently with the oxygen-containing gas, whereby conformance is improved by readjusting the mobilities of the fluids to a more favorable ratio. However, this method has not been too successful, particularly in reservoirs having numerous permeability streaks or in formations containing viscous oils. This is particularly true with tar sands.

It is thus an object of my invention to provide a recovery process wherein improved conformance is obtained by exploiting the advantages of creating thermal and compositional gradients in the formation. This improved conformance, which results in enhanced recovery, is obtained by the injection of a hydrocarbon solvent, that is saturated with a gas and thereafter establishing a heat wave in the formation. The formation then is subjected to a soak period after which it is produced to recover the hydrocarbons therein.

SUMMARY OF THE INVENTION

This invention relates to a method of recovering low-gravity viscous oils and, more particularly, bitumens from tar sands by improving the conformance in the formation by the injection of a hydrocarbon solvent saturated with a gas and thereafter establishing a heat wave, followed by a soak period and production of the formation.

DESCRIPTION OF THE PREFERRED EMBODIMENT

The object of the invention to improve oil recovery by improving conformance is accomplished by the steps of injecting a hydrocarbon solvent saturated with a gas, followed by the establishment of a heat wave or thermal sink in the formation, followed by a soak period. Thereafter, the formation is produced to recover the hydrocarbons. By the method of the invention thermal and compositional gradients are created within the formation which result in improved sweep efficiency and thus lead to increased recovery of hydrocarbons. It is within the scope of the invention to repeat the steps of the invention as a cyclic process and thereafter to scavenge the formation by the injection of water. It is also within the scope of the invention to repeat the procedure among different patterns in the formation, thereby producing the entire formation by applying the process to successive well patterns.

While the invention emphasizes its application to tar sands, it is within the scope of the invention also to apply it to the recovery of heavy oils, i.e., those oils having an API gravity below about 25° API.

In a broad aspect of the invention, a hydrocarbon-bearing formation containing a heavy oil or bitumen and having permeability variations is first traversed by at least one injection well and at least one production well. Fluid communication is established between the wells by such methods as conventional hydraulic fracturing if the initial transmissibility of the formation is too low to permit significant fluid injection.

Thereafter, a hydrocarbon solvent that is saturated with a gas or which contains significant quantities of gas dissolved therein is injected into the formation in amounts such that appreciable quantities of the dissolved gas are released upon the establishment of the subsequent thermal sink in the formation, and further so that maximum compositional gradients are set up to promote diffusion in the formation.

Solvents that are particularly useful for this application are those having high diffusion coefficients and which are soluble with the oil or bitumen. Typical solvents include aromatic hydrocarbons such as benzene, toluene, xylene and aromatic fractions of petroleum distillates. In addition such solvents may include saturated hydrocarbons having from two to six carbon atoms in the molecule such as ethane, propane, or LPG, butane, pentane, hexane and cyclohexane. Also mixtures of aromatic and saturated or naphthenic hydrocarbons may be used such as gasoline, kerosene, naphtha and gas oils. Mixtures of predominately paraffinic and naphthenic hydrocarbons may also be used such as raffinates from an aromatic extraction and debutanized bottoms.

Gases suitable for use in combination with the above solvents include carbon dioxide, methane, ethane, and under certain circumstances nitrogen and air. Generally the most favorable results are obtained when utilizing a gas having the highest solubility in a particular solvent being used. Carbon dioxide is an extremely desirable gas. Methane is also a preferred gas. Nitrogen and air may also be utilized but because of their lesser solubility are not as suitable for the process as carbon dioxide and methane. Ethane has been included both in the examples of suitable hydrocarbons and in the examples of suitable gases. Its phase behavior and thus its suitability to function as either the solvent or the gas will of course depend on the formation conditions of pressure and temperature and in the subsequent conditions at which the thermal sink is established.

After the desired amount of solvent saturated with the gas has been injected, for example an aromatic naphtha saturated with natural gas or methane, injection is terminated and a thermal sink is established adjacent the injection well by either the injection of steam or the establishment of an in-situ combustion. If steam is used it may be either saturated or superheated. The steam injection may be continued until either the appearance of steam in the produced fluids or until the volume of steam injected is some fraction of the reservoir pore volume. This fraction of the pore volume may be established from heat transfer calculations so as to optimize the amount of steam injected. If the thermal means utilized to establish the thermal sink is in-situ combustion, the injection of air or oxygen-containing gas is continued until an amount of heat has been generated in the formation sufficient to heat the desired fraction of the reservoir pore volume to a temperature in the range of about 400°–800° F, although in some cases higher temperature may be desired. The amount of air required may be established from heat transfer and energy calculations well-known in the art. Generally the temperature range attained and the requisite amount of steam or air to be injected will depend on the formation characteristics, such as pressure, permeability and porosity. In any event the amount of heat generated in the formation should be adequate to supply heat requirements necessary to maximize thermal gradients that will impart a thermal diffusion to the fluids during the soak period.

After a sufficient thermal sink has been created in the reservoir, the injection of the steam or the air for in-situ combustion is terminated and the wells are shut-in so that the formation is subjected to a soak period for a period of time sufficient to permit thermal and mass diffusion to occur.

It is postulated that at the time of termination of injection of steam or air and the commencement of the soak period, a very unstable thermal condition exists. The invaded formation is at a temperature as high as at least several hundred degrees above formation temperature. The zones or intervals that have not been heated will be heated during the soak period by convection and conduction. The sand and fluids contained therein will not permit high temperature gradients. Stated in another manner, thermal conformance is improved by the soak period.

In addition, because of the previously injected solvents, there also exists another type of unstable condition, that of compositional gradients between the solvent and the in-place fluids. During the soak period the diffusional forces that have been imparted by having the fluids come in contact with each other will accelerate mixing and viscosity reduction of the oil that has not been heated. Furthermore, the gas that was injected with the solvent adds to the unstable condition and accelerates the mixing during the soak period. With the increase in temperature in the formation, the saturation pressure of the solvent containing dissolved gas is exceeded causing the gas to come out of solution. The gas being more mobile than the liquid is displaced ahead of the solvent and into the formation where a gas saturation is created. Because of the relative permeability effects created thereby, additional improvement in conformance within the formation occurs.

In one illustration of the invention, an injection well is completed in the formation, and suitable offset wells, arranged in a five spot pattern, are completed as production wells. Thereafter, a solvent saturated with gas or having gas dissolved therein such as naphtha saturated with natural gas or methane is injected via the injection well. The amount of solvent injected should be in the range of about 0.1 to 20% of the reservoir pore volume. Once this amount has been injected, solvent injection is terminated and a thermal sink is created in the formation.

This thermal sink can be established, for example, by the injection of steam, saturated or superheated, the temperature of the steam being such that the formation in the vicinity of the injection well bore is heated to about 400° to 800° F. In the example, to attain a temperature in the desired range adjacent the injection well, approximately 5,000 barrels of saturated steam at a temperature of 500° F are injected.

In the alternative, an in-situ combustion can be initiated in the formation utilizing any of the known methods as for example, by a downhole heater or chemical means. Thereafter air, or an oxygen-containing gas is injected in amount sufficient to establish a thermal sink in the reservoir at a temperature of about 800° F.

Once the desired thermal sink is established, the steam or the air injection, dependent upon the method used, is terminated, and the reservoir undergoes a soak period. The amount of heat generated and the subsequent length of the soak period can be computed from heat and mass transfer calculation by methods known to those skilled in the art.

The production period is continued until the rate indicates the cycle should be repeated. Optionally after the production period, the formation may be water flooded, thereby scavenging any residual heat and further producing the formation.

The invention may be applied to any pattern of wells, either as a line drive or a five or nine spot pattern. The method may also be applied sequentially from one section of a reservoir to another, thereby increasing the production of the entire formation. Well patterns and spacings can be determined in accordance with the characteristics of the reservoir and the reservoir fluids.

I claim:

1. A method for recovering heavy viscous crude oils and bitumen from a subterranean hydrocarbon-bearing formation traversed by at least one injection well and one production well and having fluid communication therebetween comprising the steps of:

a. injecting via said injection well a hydrocarbon solvent in amounts of 0.1 to about 20% of the formation pore volume, said solvent containing a gas dissolved therein, b. establishing in said formation a thermal sink whereby a substantial portion of said formation is heated to a temperature of at least 400° F, c. shutting-in said wells to permit said formation to undergo a soak period, d. producing said oils and bitumen from said production well.

2. The method of claim 1 wherein step (d) is followed by the injection of water to recover additional oil and bitumen from said formation.

3. The method of claim 1 wherein said solvent includes aromatic hydrocarbons selected from the group consisting of benzene, toluene, xylene and petroleum distillation cuts high in aromatics and mixtures thereof.

4. The method of claim 1 wherein said solvent includes paraffinic and naphthanic hydrocarbons selected from the group consisting of hydrocarbons having from 2 to 6 carbon atoms in the molecule.

5. The method of claim 4 wherein said solvent is selected from the group consisting of ethane, propane, LPG, butane, pentane, hexane, cyclohexane and mixtures thereof.

6. The method of claim 1 wherein said solvent is selected from a mixture of aromatic, paraffinic and naphthenic hydrocarbons selected from the group consisting of gasoline, kerosene, naphthas, gas oils and mixtures thereof.

7. The method of claim 1 wherein said solvent is predominantly naphthenic and paraffinic.

8. The method of claim 1 wherein said solvent is raffinate from an aromatic extraction, debutanized bottoms and mixtures thereof.

9. The method of claim 1 wherein said gas is selected from the group consisting of natural gas, methane, ethane, carbon dioxide, nitrogen, air and mixtures thereof.

10. The method of claim 1 wherein said thermal sink is established by the injection of steam via said injection well.

11. The method of claim 1 wherein said thermal sink is established by in-situ combustion said in-situ combustion being initiated in the vicinity of said injection well.

12. The method of claim 1 wherein steps (a) through (d) are repeated after production has decreased below an economic level.

13. The method of claim 1 wherein said injection well and said production well comprise part of an in-line pattern having a plurality of wells.

14. The method of claim 1 wherein said injection well and said production well comprise part of a well pattern including a central injection well and a ring of offset production wells.

* * * * *